United States Patent [19]

Wu et al.

[11] Patent Number: 4,760,610

[45] Date of Patent: Aug. 2, 1988

[54] UMBRELLA CAP HAT

[76] Inventors: Bing T. Wu; Mei-Ling Wu, both of 12335 Elgers St., Cerritos, Calif. 90701

[21] Appl. No.: 100,613

[22] Filed: Sep. 24, 1987

[51] Int. Cl.[4] ..... A42B 1/18

[52] U.S. Cl. ..... 2/209.1; 2/177; 2/180; 135/16

[58] Field of Search ..... 2/177, 180, 209.1, 196, 2/182.6; 135/16, 31, 20 A, 25 R, 35 S, 31

[56] References Cited

U.S. PATENT DOCUMENTS

| | | | |
|---|---|---|---|
| 250,803 | 12/1881 | Gray . | |
| 2,726,668 | 12/1955 | Levine | 135/16 |
| 3,049,720 | 8/1962 | Caine | 2/171 |
| 4,131,954 | 1/1979 | Brock | 2/177 |
| 4,148,102 | 4/1979 | Ying-Yu | 2/177 |
| 4,326,301 | 4/1982 | Brock | 2/177 |
| 4,641,675 | 2/1987 | Wu | 135/16 X |
| 4,675,916 | 6/1987 | Orsini | 2/177 X |

FOREIGN PATENT DOCUMENTS

| | | | |
|---|---|---|---|
| 0525560 | 6/1954 | Italy | 2/177 |
| 0194057 | 11/1937 | Switzerland | 135/16 |

*Primary Examiner*—Peter Nerbun

*Attorney, Agent, or Firm*—Harpman & Harpman

[57] ABSTRACT

An umbrella configured in the shape of a cap, having a main canopy from which extends about a portion of the lower perimeter a brim canopy when in open extended position. The brim canopy folds upwardly against the main canopy as it is closed. A fabric head band is suspended from the brim canopy. A head engageable shaft stabilizes the umbrella cap on the wearer.

3 Claims, 1 Drawing Sheet

UMBRELLA CAP HAT

BACKGROUND OF THE INVENTION

1. Technical Field:

This invention relates to umbrella hats that are positioned on the head of a user. The umbrella hats have a plurality of ribs that support a fabric covering and a head engagement portion connected thereto.

2. Description of Prior Art:

Prior Art devices of this type have relied on a variety of different design configurations to attach a small umbrella to the head of the user for hands free support, see for example U.S. Pat. Nos. 2,726,668; 3,049,720; 4,326,301; 4,131,954; 4,148,102 and applicant's own cap umbrella U.S. Pat. No. 4,641,675.

In U.S. Pat. No. 2,726,668 a parasol is disclosed having a removable handle portion and a attachable cap with a chin strap.

U.S. Pat. No. 3,049,720 discloses a head gear having a umbrella portion with support ribs and a head band secured to said ribs by multiple support rods extending from said ribs.

U.S. Pat. No. 4,131,954 discloses a collapseable head gear wherein rib members with spherical inner ends are engaged in multiple sockets on a hub. The ribs can thus fold to lie along side the hub. A head band is supported from a plurality of rigid supports, the ends of which are apertured to allow the ribs to pass through when folded.

U.S. Pat. No. 4,148,102 discloses a umbrella like hat having a short center shaft with multiple fabric supporting ribs extending therefrom. A string is used to hold the hat on extending under the chin of the wearer.

U.S. Pat. No. 4,326,301 shows a collapseable sun shade having multiple segment ribs with a fabric cover. Struts extend longitudinally between a sleeve and the ribs with a leg extending therefrom at each junction from which is secured a fabric head band.

Applicant's own earlier U.S. Pat. No. 4,641,675 discloses and claims an umbrella having a deployable rim canopy supported by support arms extending therefrom to a annular ring on a shaft. The disclosed umbrella is in the shape of a sports cap when opened.

SUMMARY OF THE INVENTION

A umbrella cap hat configured in the shape of a sports related head gear when open having a conventional umbrella canopy with the addition of a brim canopy extending outwardly from a portion thereof. A head band is secured from the brim canopy supports with the head engageable extensible main shaft supporting the umbrella cap hat on the users head.

DESCRIPTION OF THE PREFERRED EMBODIMENT

Figure 1:
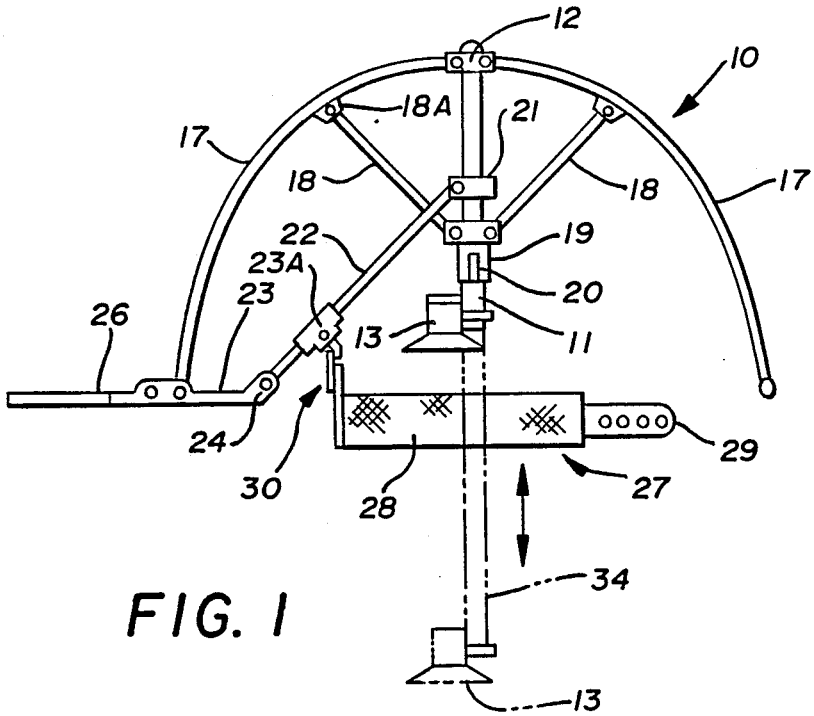
FIG. 1 is a side plan view of a pair of support ribs of the umbrella cap hat in open position.

Referring to FIG. 1 of the drawings, a umbrella cap hat 10 can be seen having a shaft 11 with a crown 12 on one end and a head engageable cup 13 on the other end.

An umbrella canopy 14 extends from the crown in a generally arcuate configuration downwardly around the shaft 11 being spaced in relation thereto at the canopy's perimeter 15. A brim canopy 16 extends outwardly from a portion of the canopy's perimeter 15 on a horizontal plane defining a curved brim. The crown 12 has a plurality of canopy support ribs 17 pivotally secured therefrom in spaced radial pattern. A plurality of deployment arms 18 are pivotally extended from a sleeve 19 movably positioned on the shaft 11. Each of the deployment arms 18 are pivotally secured at their free ends to a respective canopy support rib 17 at a point 18A defined by approximately one-third their overall length from the said crown 13. A spring urged pivot lock arm 20 is positioned on the sleeve 19 and is registerable within an aperture in the shaft 11 adjacent the crown 12 to lock the sleeve 19 to the shaft 11 at a predetermined position extending the canopy support ribs 17 into an open position as best seen in FIGS. 1 and 2 of the drawings.

An annular ring 21 is movably positioned on the shaft 11 between the sleeve 19 and the crown 12. A number of brim canopy deployment support arms 22 are pivotally secured to and extend from the annular ring 21. A rib connector fitting 23 has an angularly disposed end portion 24 with a number of spaced apertures positioned on the end portion 24, midway along the connector fitting and adjacent thereto. Each of the rib connector fittings 23 is pivotally secured to each of the free ends of the respective brim canopy deployment support arms 22 and corresponding canopy support ribs 17 adjacent the brim canopy deployment support arms 22. A plurality of brim ribs 26 are secured to the free ends of the rib connector fitting 23.

Figure 2:
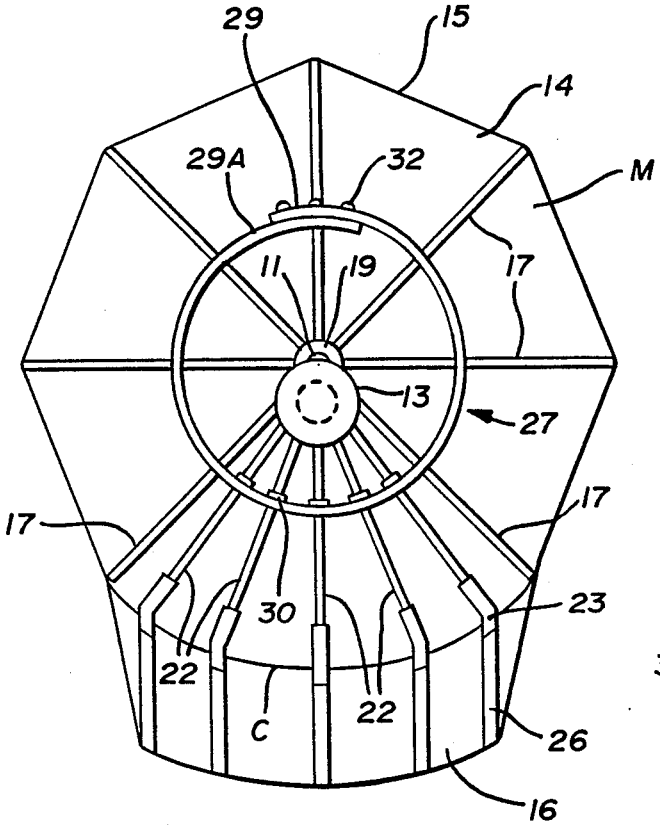
FIG. 2 is a top plan view of the umbrella cap hat showing the support ribs and head band.

At least two of the brim ribs 26 are of a length less than that of the other of said brim ribs, all of which define the brim canopy 16 as seen in FIG. 2 of the drawings.

Figure 3:
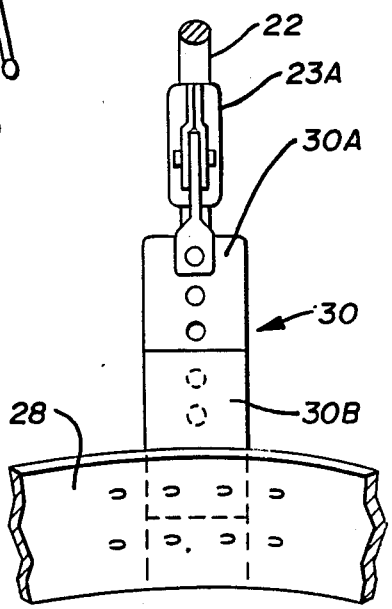
FIG. 3 is an enlarged front plan view of a portion of the head band and related support straps.
Figure 4:
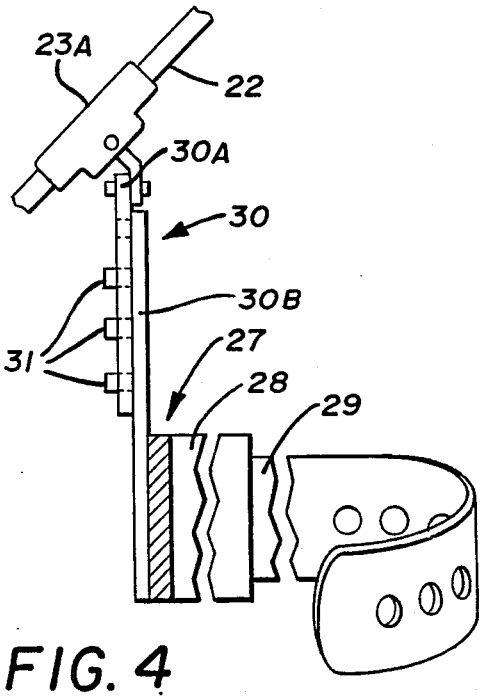
FIG. 4 is an enlarged side plan view of the portion of the head band shown in FIG. 3.

Referring now to FIG. 1, 3, and 4 of the drawings, a flexible head band 27 can be seen having an elongated band like body member 28 with adjustable elongated tabs 29 and 29A extending from the respective free ends thereof. A plurality of adjustable band support straps 30 are secured to the brim support arms 22 inwardly from their junction with the rib connector fittings 23 by a pivoted fitting 23A affixed to the arms 22. Each of the band support straps 30 are comprised of two interdependent portions 30A and 30B with the strap portions 30A directly secured to the brim support arms 22 as hereinbefore described and the strap portions 30B secured directly to the head band 27. The strap portions 30A each have a plurality of spaced apertures that are selectively engaged over corresponding pegs 31 extending from one side of the strap portions 30B, best seen in FIG. 4 of the drawings. This arrangement allows for vertical adjustment of the strap portions 30A and 30B in relation to one another to vary the relative distance from the head band 27 to the brim support ribs 22.

The adjustable tab 29 extending from the end of the head band 27 has a plurality of spaced aligned apertures for engagement with corresponding pegs extending from one side of the adjustable tab 29A on the opposite end of the head band 27.

It will be evident that the size of the head band 27 can be adjusted by the overlapping of the tabs 29 and 29A to provide for multiple adjustment thereto.

Referring now to FIGS. 1 and 2 of the drawings, the shaft 11 can be seen having a telescopically extensible portion 34 shown in broken lines in FIG. 1. When this telescopically extensible portion 34 is extended, it can be held by the user as a regular umbrella configuration. The extensible portion 33 will lock in both the extended position or the closed collapsed position shown in FIG. 1.

The head engageable cap cup 13 is adjustably secured to the end of the shaft 11 just off center of said shaft so when in use as a hat cap it will rest on the wearers head (not shown) holding and stabilizing the umbrella hat cap in spaced relation to the head of the wearer.

In operation material M is fitted over the ribs 17 as in a conventional umbrella. The brim canopy has a separate material covering which is attached to the bottom perimeter edge of said material M and secured to the apertures in the rib connector fitting 23 via a cord C engageable therethrough with the cord sewn on the underside of the brim canopy 16. Once the umbrella hat cap is open the head band 27 is placed around the head of the user and the cup 13 rests on top of the users head making the umbrellas hat cap self-supporting and hands free. To close the umbrella hat cap the lock arm 20 is disengaged from the shaft 11 allowing the sleeve 19 to slide downwardly, collapsing the ribs 17 as the deployment arms 18 follow the sleeve 19. The brim ribs 26 pivot upwardly as the brim canopy deployment arms 22 follow the annular ring 21 move down the shaft to a collapsed or closed position.

Thus, it will be seen that a new and useful umbrella hat cap has been illustrated and described and it will be apparent to those skilled in the art that various changes and modifications may be made thereto without departing from the spirit of the invention.

Therefore, I claim.

1. An improvement for an umbrella, the umbrella having a support shaft, a handle portion of the shaft, a canopy defined by a plurality of canopy support ribs and a rib deployment mechanism which includes a sleeve, a water repellent material secured to and over said canopy support ribs, a brim canopy extending around a portion of the perimeter of the canopy, the brim canopy comprising a number of brim ribs, separate material covering said brim ribs, a plurality of brim canopy deployment support arms pivotally secured to said brim ribs, the improvement comprises a flexible head band, a plurality of head band support straps secured to said head band and to said brim ribs, means for adjusting said support straps, a telescopically extensible shaft portion interengaging said handle portion of the shaft, a head engageable cup on said telescopically extensible shaft portion, and means for adjusting said head band.

2. The improvement for an umbrella of claim 1 wherein said means for adjusting said support straps comprises inter-dependent strap portions wherein one of said strap portions has a plurality of spaced aligned apertures and the other of said strap portion has correspondingly spaced engagement pegs.

3. The improvement for an umbrella of claim 1 wherein said support straps are movable on said brim canopy deployment support arms.

* * * * *